United States Patent [19]

Hoffman

[11] Patent Number: 4,770,421

[45] Date of Patent: Sep. 13, 1988

[54] CARD SHUFFLER

[75] Inventor: Lionel Hoffman, Wyckoff, N.J.

[73] Assignee: Golden Nugget, Inc., Las Vegas, Nev.

[21] Appl. No.: 55,912

[22] Filed: May 29, 1987

[51] Int. Cl.[4] ..... A63F 1/12

[52] U.S. Cl. ..... 273/149 R

[58] Field of Search ..... 273/149

[56] References Cited

U.S. PATENT DOCUMENTS

| | | | |
|---|---|---|---|
| 1,014,219 | 1/1912 | Hall | 273/149 R |
| 1,867,690 | 7/1932 | Wendorff | 273/149 R |
| 2,016,030 | 10/1935 | Woodruff et al. | 273/149 B |
| 3,147,978 | 9/1964 | Sjostrand | 273/149 R |
| 3,588,116 | 6/1971 | Miura | 273/149 R |
| 3,589,730 | 6/1971 | Slay | 273/149 R |
| 3,897,954 | 8/1979 | Erickson et al. | 273/149 R |
| 3,929,339 | 12/1975 | Mattioli | 273/148 A |
| 4,033,580 | 7/1977 | Pic | 273/149 R |
| 4,310,160 | 1/1982 | Willette et al. | 273/149 R |
| 4,497,488 | 2/1985 | Plevyak et al. | 273/149 R |
| 4,512,580 | 4/1985 | Matviak | 273/149 R |
| 4,513,969 | 4/1985 | Samsel, Jr. | 273/149 R |
| 4,515,367 | 5/1985 | Howard | 273/149 R |
| 4,586,712 | 9/1986 | Lorber et al. | 273/149 R |
| 4,659,082 | 4/1987 | Greenberg | 273/149 R |

*Primary Examiner*—William L. Freeh
*Assistant Examiner*—T. Olds
*Attorney, Agent, or Firm*—Brumbaugh, Graves, Donohue & Raymond

[57] ABSTRACT

A card shuffler has a plurality of vertically stacked mixing pockets for holding cards. A first vertically traveling elevator holding cards to be shuffled distributes cards one at a time in sequence to the mixing pockets in accordance with a first distribution schedule. A second vertically traveling elevator on the opposite side of the mixing pockets from the first elevator picks up all of the cards from each mixing pocket one mixing pocket at a time in sequence according to a second distribution schedule. Cards from the second elevator are transferred to an output reservoir for use by a dealer.

17 Claims, 5 Drawing Sheets

CARD SHUFFLER

This application is a continuation-in-part of my copending application Ser. No. 047,286, filed May 6, 1987 (now abandoned).

BACKGROUND OF THE INVENTION

The present invention relates to a card shuffler for shuffling or intermixing playing cards, and has particular application for use in the game of blackjack.

In the game of blackjack as played in the major casinos, a good intermix of cards is necessary to obtain a random arrangement of the cards and to thwart the efforts of card counters, i.e. persons who keep track of the particular cards played to determine, e.g., the balance of high and low cards remaining in the dealer's card stack yet to be played. However, even for dealers who shuffle cards very fast requires a certain amount of time, which takes away from the time available for playing the game, thus reducing the amount of playing time. Moreover, the customer's interest in the game typically wanes during the time that the dealer attends to shuffling the cards and this may cause some players to leave the playing table.

It is an object of the present invention to provide a card shuffler for shuffling of playing cards to eliminate shuffling time spent by the dealer.

It is another object of the invention to provide a card shuffler which provides a good intermix of several decks of playing cards.

It is a further object of the invention to provide a card shuffler which shuffles played cards and places them back into the dealer's supply of cards in a cyclical manner so that the dealer not only has a continuous supply of cards, but also that the card counters will not be able to determine with any degree of accuracy the balance of high and low cards to be dealt soon. Because, as compared to games where the dealer shuffles and plays to the "end" of his card supply, there is no "end" of the card supply when the played cards are immediately shuffled and placed back with the other shuffled cards for the dealer.

It is a still a further object of the invention to provide a card shuffler having a card through-put which will exceed, or at least keep pace with, the rate at which the cards are used.

SUMMARY OF THE INVENTION

According to the invention, a card shuffler is provided comprising a plurality of mixing pockets for holding cards, and card holding and distribution means for holding a stack of cards and for distributing and transferring at least one card at a time to said mixing pockets in accordance with a first distribution schedule. An output reservoir is provided for holding cards, and card transfer means transfers cards from each mixing pocket to said output reservoir in accordance with a second distribution schedule, to thereby provide shuffled cards to said output reservoir.

According to a more particular form of the invention, a card shuffler is provided comprising a plurality of mixing pockets for holding cards, and card holding and distribution means for holding a stack of cards and for distributing and transferring one card at a time in sequence to said mixing pockets in accordance with a first distribution schedule. Card pickup and delivery means are provided along with an output reservoir for holding cards. First card transfer means, associated with said mixing pockets, are provided for transferring to said card pickup and delivery means all of the cards from each mixing pocket one mixing pocket at a time in sequence in accordance with a second distribution schedule. Second card transfer means, associated with said card pickup and delivery means, are provided for transferring the cards from said card pickup and delivery means to said output reservoir, to thereby provide shuffled cards to said output reservoir.

Other objects and advantages of the invention will become apparent from the following detailed description, appended claims and accompanying drawings.

DETAILED DESCRIPTION OF THE PREFERRED EMBODIMENT

Structure of the Card Shuffler

Figure 1A:
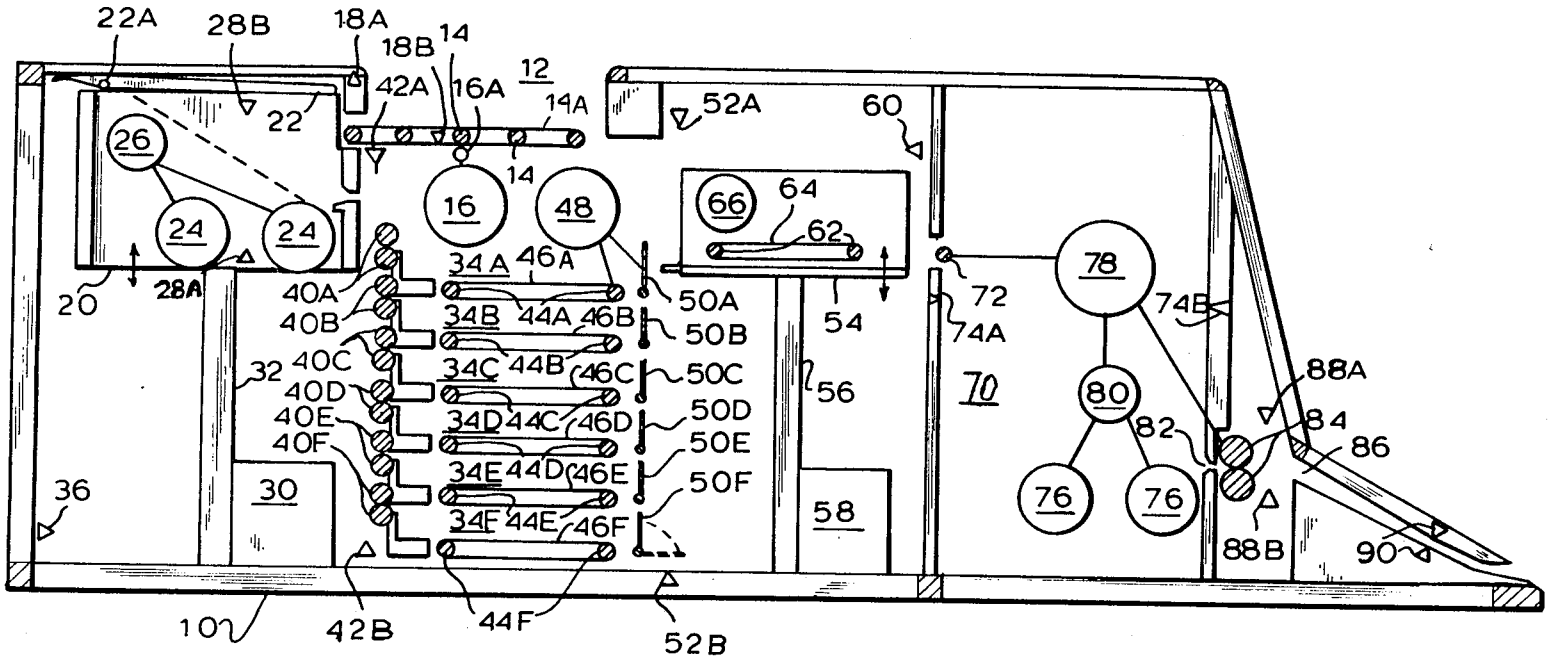
FIG. 1A is a side elevational view, in partial cross section, of a card shuffler according to the invention.

Referring now to FIG. 1A, the structure of the card shuffler will now be described. A card shuffler has a housing 10 and a loading station 12 having on its floor a group of rollers 14 which are driven by a roller drive motor 16 through an overrunning or one-way clutch 16A. A band 14A encircles the rollers 14. A loading sensor 18A/18B is also provided for the loading station 12 and detects whether the loading station is empty. The loading station is accessible through the exterior of the housing so that a dealer can insert cards to be mixed into the loading station.

To the left of the loading station 12 is a distribution elevator 20. A distribution elevator 20 has a spring loaded pressure arm 22 which exerts pressure on cards in the distribution elevator so that firm contact of the lowermost card in this stack against distribution elevator feed rollers 24 will be provided. Pressure arm 22 pivots about pin 22A and is released from the dashed line position shown in FIG. 1 to the solid line position shown when the end 22B of the arm is forced down by contact with the ceiling of the housing as shown. A distribution elevator feed roller drive motor 26 drives the distribution elevator feed rollers 24 in response to certain signals from a control unit as will be described below. A distribution elevator sensor 28A/28B is provided in the distribution elevator and detects when the distribution elevator is empty.

The distribution elevator is adapted to be moved vertically up and down. As shown in FIG. 1A, the distribution elevator is in its uppermost vertical position for receiving cards from loading station 12. In response to signals from the control unit which will be described below, a distribution elevator position motor 30 moves the distribution elevator 20 along a vertical guide 32 to enable the cards in the distribution elevator to be fed into mixing pockets 34A through 34F. A distribution elevator position sensor 36 is located at the bottom of the housing provides, in addition to a stepping motor and timing belt to be described below, information to the control unit regarding the vertical position of the distribution elevator.

In response to signals from the control unit, the distribution elevator 20 will move vertically to a position so that the distribution elevator exit slot 38 will be even with one of the mixing pocket loading roller pairs 40A through 40F. Roller drive motor 16 is also connected to the mixing pocket roller pairs 40A through 40F to drive the roller pairs and feed a card from the distribution elevator 20 into the top of the appropriate mixing pocket. A pocket loading sensor 42A/42B is provided to detect whether any portion of a card is present in any of the mixing pocket roller pairs 40A through 40F.

When rotated in one direction, the roller motor 16 through clutch 16A rotates the rollers 14 and moves the cards to the left into the distribution elevator. The rollers 40A–40F also rotate, but in reverse of their intended direction. When rotated in the other direction the roller motor rotates rollers 40A–40F in their intended direction to feed cards into the appropriate mixing pocket, and the clutch overruns so that rollers 14 do not rotate.

The floor of each mixing pocket 34A through 34F is provided with rollers 44A through 44F, respectively, around which conveyor bands 46A through 46F, respectively, are mounted as shown. The rollers 44A through 44F are driven by pocket roller motor 48 in response to signals from the control unit. To the right of the mixing pockets 34A through 34F are provided gates 50A through 50F to prevent cards from shooting out of the mixing pockets on the right side as they are fed into the mixing pockets by the distribution elevator 20. Further details regarding the structure and operation of these gates will be described below. A mixing pocket exit sensor 52A/52B is provided to detect whether any portion of a card is present leaving the mixing pockets.

A reservoir feed elevator 54 is provided to the right of the mixing pockets and moves vertically upward and downward along vertical guide 56 as driven by reservoir elevator position motor 58 in the same general manner as that of distribution elevator 20. A reservoir feed elevator position sensor 60 provides information to the control unit regarding the vertical position of the reservoir feed elevator 54. The floor of the reservoir feed elevator 54 is provided with conveyor rollers 62 encircled by a band 64 which are driven by reservoir elevator roller drive motor 66 in response to signals from the control unit.

To the right of the reservoir feed elevator 54 is a reservoir 70 having at its upper left edge a reservoir loading roller 72. Reservoir 70 also has a reservoir level sensor 74A/74B to detect when the level of cards in the reservoir 70 drops below this level. At the floor of the reservoir 70 are a pair of reservoir feed rollers 76 which are driven by reservoir feed roller drive motor 78 through a clutch 80 in response to signals from the control unit. Motor 78 also drives reservoir loading roller 72. A slot 82 is provided at the lower right edge of the reservoir 70 to feed the lowermost card from the stack of cards in the reservoir to reservoir exit rollers 84 and into dealing slot 86. A reservoir exit sensor 88A/88B is also provided to detect when a card is present in the dealing slot 86. Also provided is a deal switch sensor 90 connected to the control unit, for purposes to be described below.

Figures 1B, 1C, 1D, 1E:
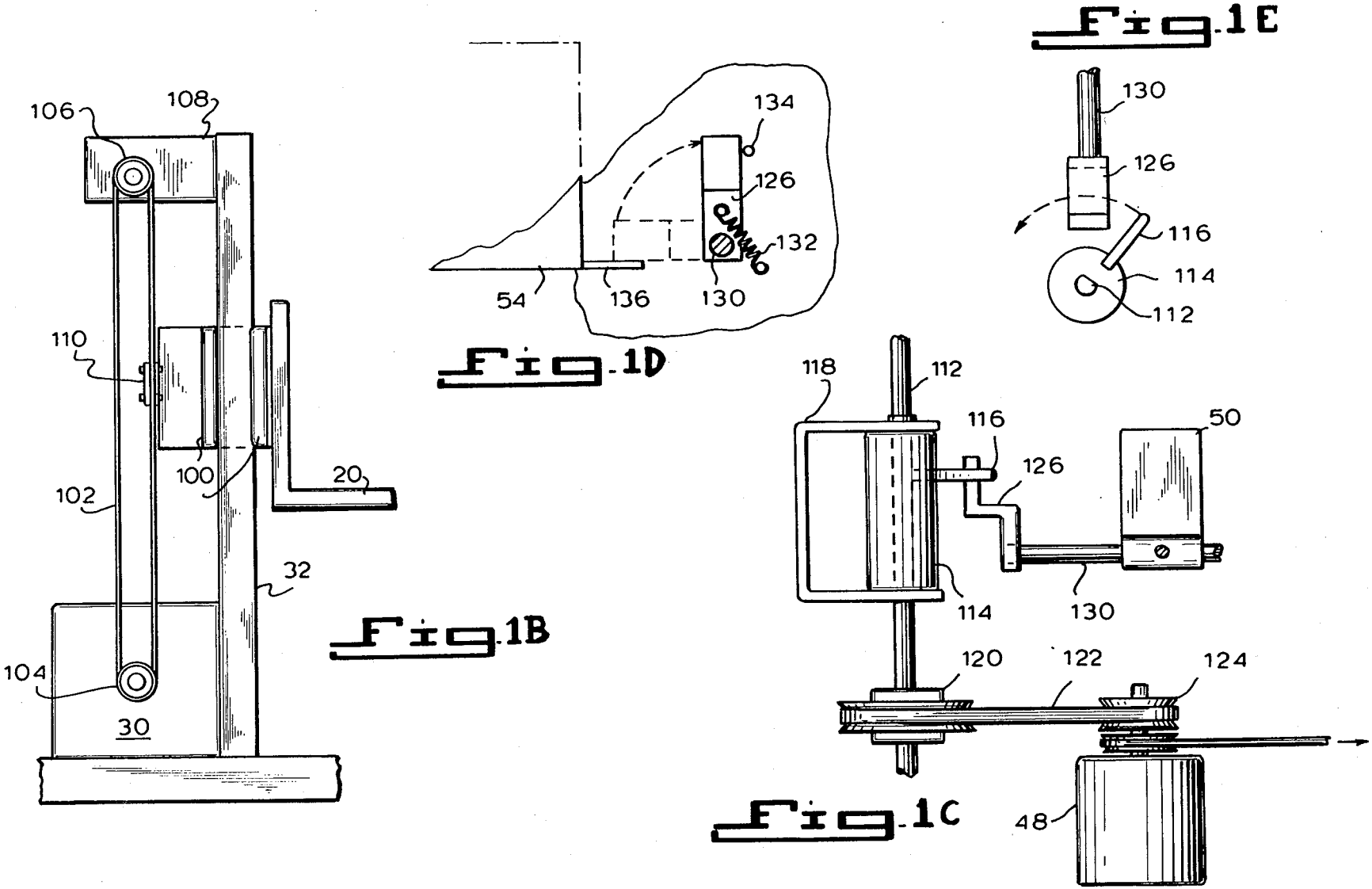
FIG. 1B is a side elevational view of the distribution elevator.
FIG. 1C is an elevational view of an exit gate mechanism for a mixing pocket.
FIG. 1D is an elevational view of another portion of the exit gate mechanism of FIG. 1C.
FIG. 1E is a top view of a portion of the gate mechanism shown in FIG. 1C.

Referring now to FIG. 1B, the distribution elevator 20 is mounted to slider 100 which slides vertically on vertical guide 32. A timing belt 102 with teeth (not shown) is mounted on timer pulley 104, which drives the belt through motor 30, and timing belt idler pulley 106, mounted on an upper support 108 of vertical guide 32. The slider 100 is mounted to belt 102 by means of clamp 110. The reservoir feed elevator 54 has a similar arrangement for vertical movement on its vertical guide 56. The slider assembly is available as a unit called a linear ball bearing slide from THK America as model THK RSR.

FIGS. 1C, 1D and 1E show the gate mechanism arrangement for a mixing pocket. As shown in FIG. 1C, a vertical shaft 112 has slidingly mounted thereon an actuator 114 having an extending tab 116. The shaft 112 has a flatted side along its entire length, its cross-section being shown in FIG. 1E, and the actuator 114 has a correspondingly shaped opening, so that the tab 116 always extends in the direction of the flatted side of the shaft 112. In FIG. 1C, a bracket 118, which is attached to the reservoir feed elevator 54, vertically guides the actuator to keep the actuator at the same vertical position as the elevator 54. The shaft 112 is also connected to motor 48 through a clutch 120, belt 122 and pulley 124 attached to the shaft of motor 48. Gate lever 126 and gate 50 are mounted on a shaft 130. (Actually two gates 50 are provided for each mixing pocket, but only one is shown). The gate lever 126 has an over-center spring 132 which holds the lever 126 in the vertical position against stop 134 (gate closed position), or in the horizontal position shown in dotted lines in FIG. 1D against horizontal tab 136 (gate open position). When the elevator 54 stops at a mixing pocket, motor 48 is turned on to rotate in a selected direction to cause shaft 112, actuator 114 and tab 116 to rotate and trip gate lever 126, causing gate 50 for a particular mixing pocket to open. When the elevator 54 moves upward, which it does after receiving cards from the mixing pocket, the tab 136 urges the gate lever to the vertical gate closed position as shown in FIG. 1D.

The foregoing description has been given for a gate 50, with the understanding that gate 50 is representative of any of gates 50A, 50B, 50C, 50D, 50E or 50F.

The motor 48 drives the rollers 44A–44F to the right (clockwise) as shown in FIG. 1A when the motor 48 turns in one direction. At this time clutch 120 prevents the shaft 112 from rotating. When the motor 48 rotates in the other direction the gate is driven and opened, and the rollers 44A–44F rotate counterclockwise, causing the cards to skid on the belts 46A–46F.

Operation of the Card Shuffler

Referring now to FIGS. 2A through 2D the operation of the card shuffler will now be described.

Figure 2C:
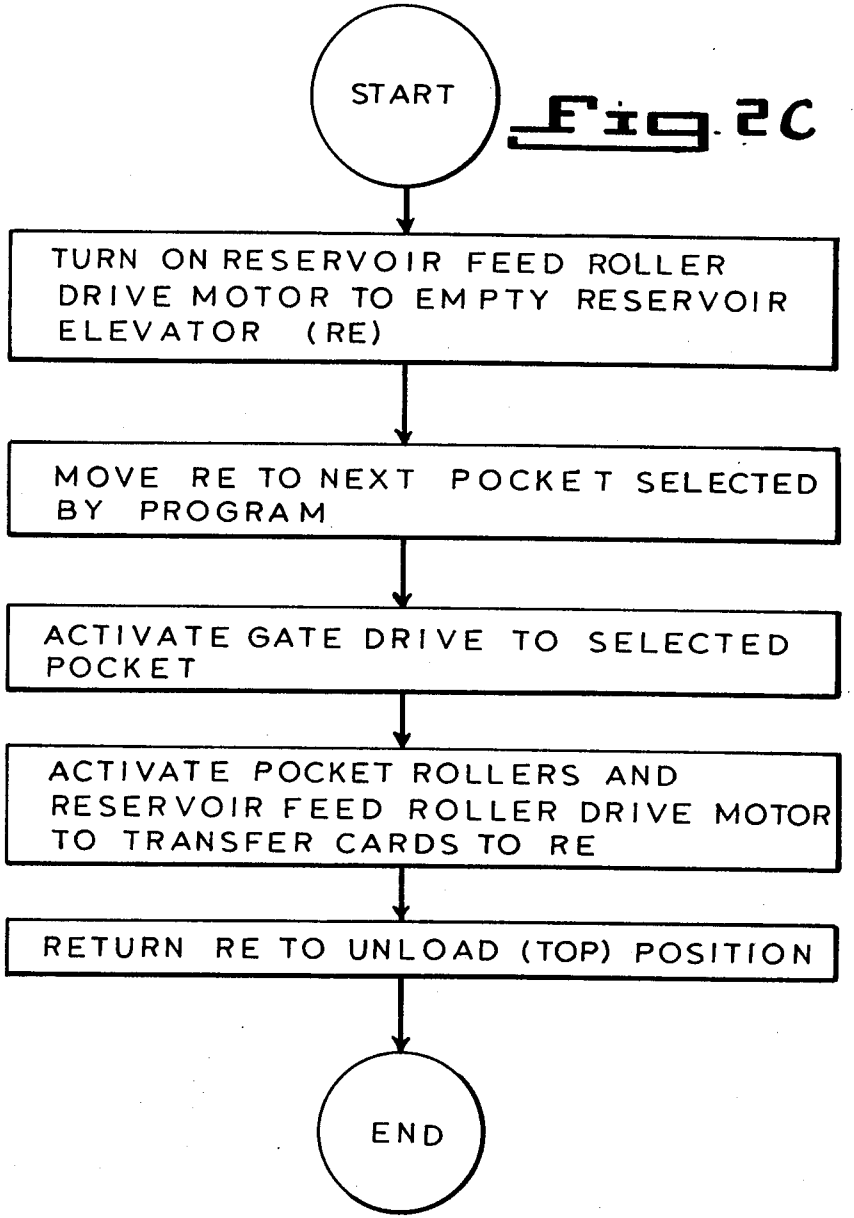
FIGS. 2A–2D are flowcharts of the control program for the control unit for the embodiment of FIG. 1.
Figure 2A:
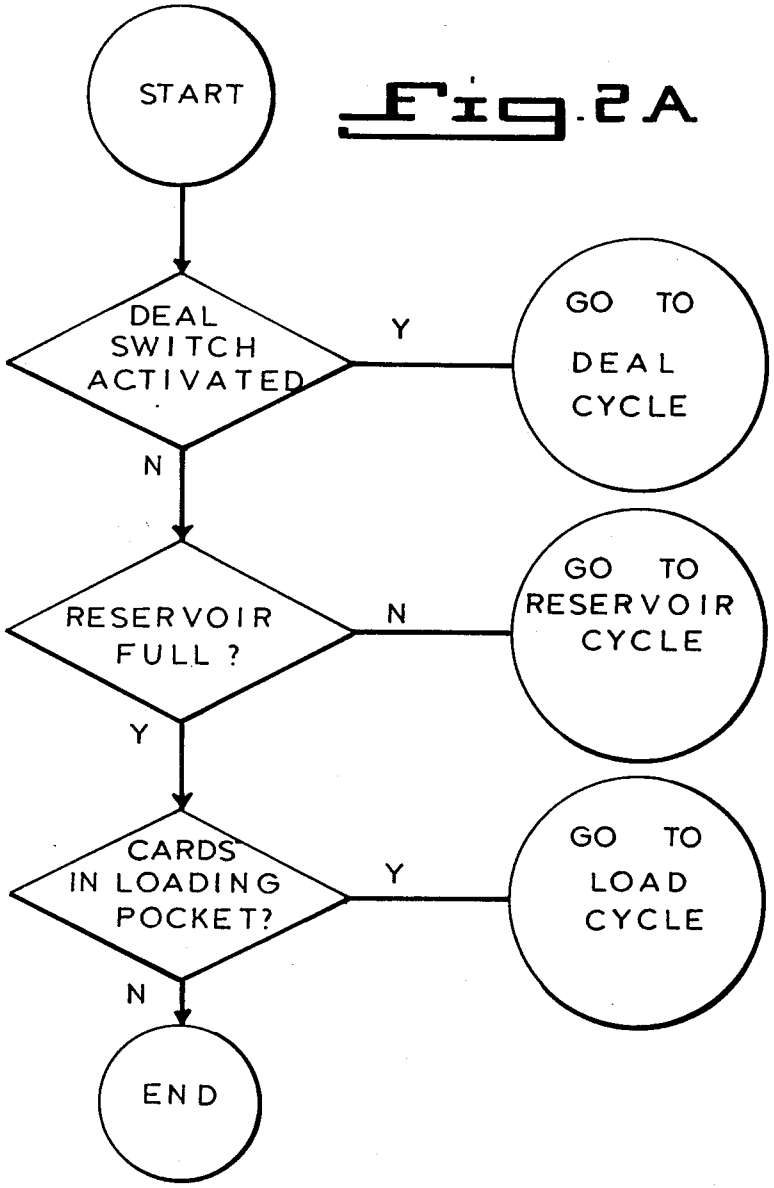

As shown in FIG. 2A, which shows the main program operating the control unit, the system first determines whether the deal switch has been activated. If it has, the program goes through the Deal Cycle. If not, the program then determines whether the reservoir is full by reference to the reservoir level sensor 74. If it is not full, the program goes to the Reservoir Cycle. If the reservoir is full, the program determines whether any cards are in the loading station by reference to sensor 18. If cards are not in the loading station, the main program ends and restarts again in a cyclical manner. If cards are in the loading station, the program proceeds to the Load Cycle.

Figure 2D:
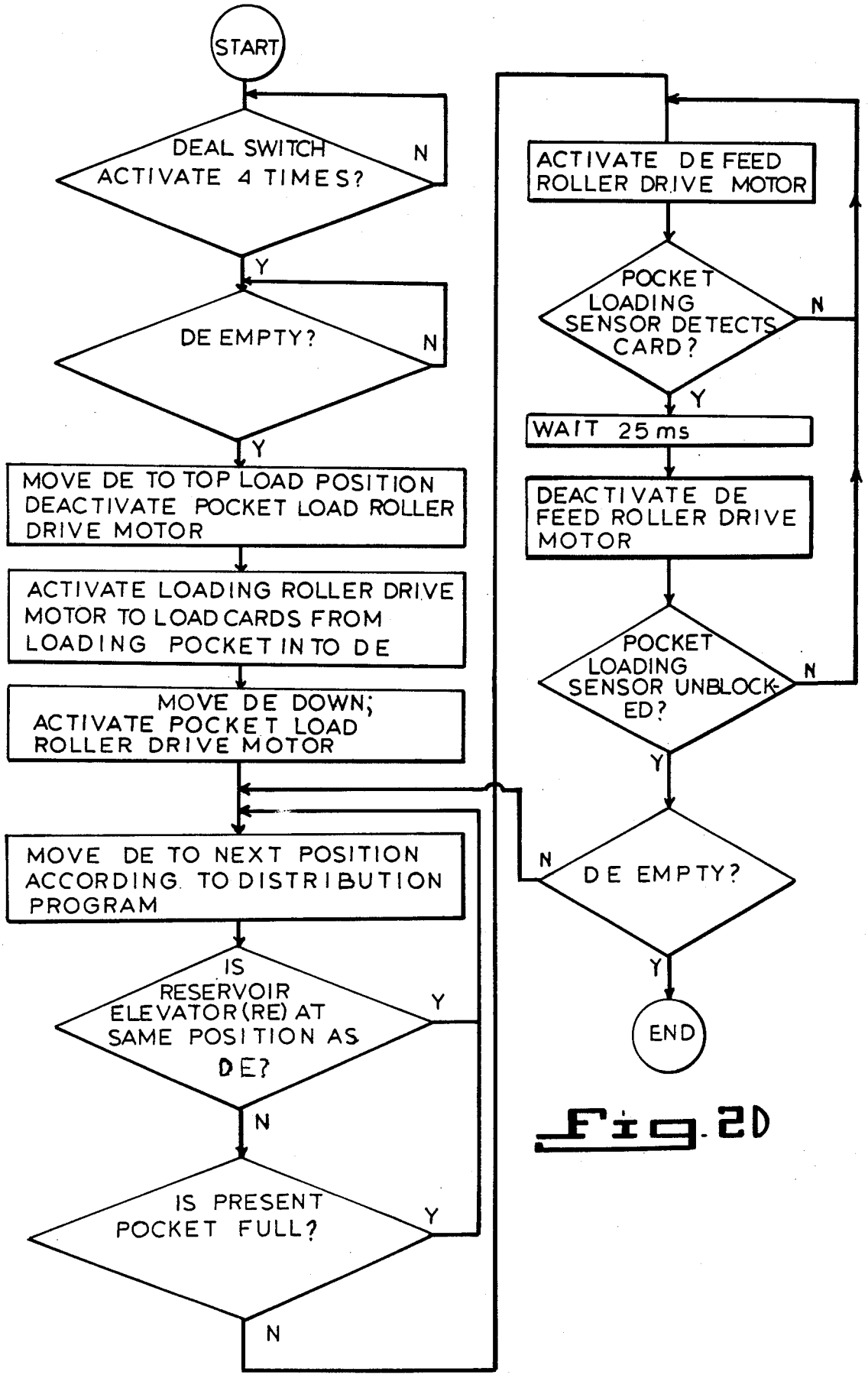
Figure 2B:
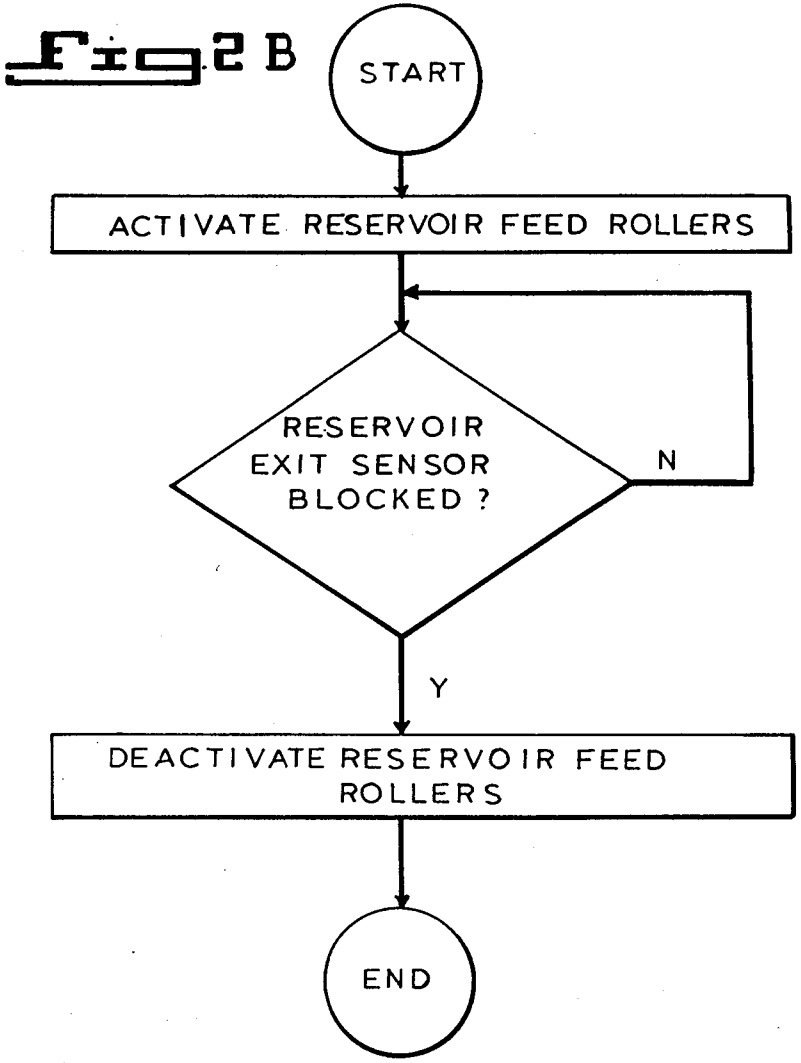

Referring now to FIG. 2B, the Deal Cycle program comprises first activating reservoir feed rollers 76 by energizing reservoir feed roller drive motor 78 through a clutch 80 by way of the control unit. The reservoir feed rollers will continue to be energized until the card is detected by the reservoir exit sensor 88, whereupon the reservoir feed roller drive clutch 80 is deenergized. Rollers 84 continue to transport the card into the dealing slot 86.

Referring now to FIG. 2C, the Reservoir Cycle starts by turning on the reservoir elevator roller drive motor 66 to transfer the cards from the reservoir feed elevator 54 into the reservoir 70. The reservoir feed elevator 54 is then moved vertically downward to the next pocket selected by the program in the control unit. The motor 48 is then energized to open the gate 50 for the selected mixing pocket. The pocket roller motor 48 is energized, and the reservoir elevator roller drive motor 66 is also energized to transfer cards from the appropriate mixing pocket to the reservoir feed elevator 54. Once this is done, the reservoir feed elevator returns to its top vertical position as shown in FIG. 1A.

Referring now to the Load Cycle of FIG. 2D, the program determines whether the deal switch 90 has been activated. The machines waits for at least four cards to be dealt after the deal switch is activated before removing cards from the loading station 12, to make sure that the cards are available for retrieval from the machine if any questions are asked about the previous hand played. After four cards have been dealt, as indicated by activation of the deal switch 90 four times, the program waits for the elevator 20 to return to the top vertical position, which occurs when the elevator 20 is empty by checking the status of sensor 28A/28B. Even when empty, elevator 20 will not return to the top vertical position unless cards are sensed in loading station 12 by sensors 18A/18B. When the distribution elevator 20 returns to the top vertical position, the pressure arm 22 will be released as described above. The loading roller drive motor 16 is then activated to load cards from the loading station 12 into the distribution elevator 20. The distribution elevator then moves vertically downward to the next position according to the distribution program.

The program then determines whether the reservoir elevator 54 is at the same position as the distribution elevator 20. If they are at the same position, the distribution elevator 20 does not feed a card into the mixing pocket, or else the card will be shot out of the right hand side of the mixing pocket straight into the reservoir feed elevator 54. Alternatively, while not shown in FIG. 2D, the distribution elevator can wait until the reservoir elevator 54 moves to another position, whereupon the distribution elevator will feed its card into that mixing pocket. Once the distribution elevator is positioned next to a mixing pocket which does not have the reservoir feed elevator at the same vertical position, the program determines whether the present mixing pocket is full by reference to a count stored in the control unit for that pocket. If the respective pocket is full, the distribution elevator is moved to the next position according to the distribution program. If the present pocket is not full, the distribution elevator feed roller drive motor 26 is then activated to deliver the lowermost card from the stack of cards in distribution elevator 20 into the next mixing pocket 34. Twenty-five milliseconds after the pocket loading sensor 42A/42B detects a card, the distribution elevator feed roller drive motor 26 is deactivated. The program then determines whether the pocket loading sensor 42A/42B is unblocked. If it is, the program determines whether the distribution elevator 20 is empty with reference to the distribution elevator sensor 28A/28B. If it is, the distribution elevator is raised to the top load position as shown in FIG. 1A to receive more cards from the loading station 12. If the distribution elevator is not empty, the distribution elevator stops at the next pocket position in accordance with the control program, and continues this mixing pocket loading cycle until the distribution elevator is empty, whereupon this Loading Cycle portion of the program ends.

PROGRAMS FOR DISTRIBUTION ELEVATOR AND RESERVOIR ELEVATOR

The distribution elevator is programmed to place cards one at a time into the six storage or mixing pockets in a variable sequence. In accordance with the invention a number of distribution programs are provided which provide the exact sequence of distribution. In the preferred embodiment, two sets of distribution programs are provided, a 10-program distribution set and a 20-program distribution set. In the 10-program set, the control program randomly selects one of the 10 distribution programs, and each distribution program loads 128 cards into the mixing pockets according to a distribution schedule defined beforehand. Alternatively, the control program can proceed from one distribution program to the next in a consecutive manner. The distribution schedule preferably provides for each card to be loaded into a mixing pocket which is within one or two pockets, in either direction, away from the pocket just loaded. By keeping the distance between consecutively loaded pockets to two pockets or less, the card throughput of the machine is improved relative to a distribution schedule which is not defined in this manner. In the 20-program set, each program loads 64 cards, but is otherwise similar to the 10-program set.

Table A shows an example of a distribution schedule of the first 50 cards to the mixing pockets of a 64 or 128 card distribution schedule. The distribution schedules are preferably written so that at the completion of an 128 card schedule, each mixing pocket will have received substantially the same number of cards i.e. 21–22 cards, while at any one time during the schedule the number of cards received by each pocket will likely be unequal.

The distribution elevator moves at a speed of about one-half second per pocket and takes about one-half second to insert a card into a pocket. For the first 50 cards of the schedule as shown in Table A, the distribution elevator moves a total travel distance of 72 pockets, (moving a one-pocket distance 28 times and a two-pocket distance 22 times) which takes about 36 seconds. Adding another 25 seconds for inserting these 50 cards gives a total of 61 seconds for 50 cards, or 1.22 seconds per card, which should be under the fastest rate of demand for cards in most casino card games.

The distribution schedules may be stored in program memory, and the data stored may simply be information representing the direction and distance that the distribution elevator should travel to the next mixing pocket (e.g. +1, −2 etc.). Many distribution schedules may be provided, and a random selection process is used to select the next distribution schedule after one schedule has been completed.

The capacity of the distribution elevator may be about 40 cards. As soon as it is empty, which will likely be in the middle of a distribution schedule, the distribution elevator simply stops at the last pocket filled and waits until the loading station is ready to deliver cards to the distribution elevator. The distribution elevator then rises and receives additional cards from the loading station. Once filled the distribution elevator simply continues with the remainder of the present distribution schedule. Accordingly, the loading of the distribution elevator is not dependent on whether the distribution schedule is at its beginning, middle or end.

The reservoir feed elevator also operates according to a program, but its speed is not critical (maybe 5 seconds per cycle) because as many as 20 cards (the capacity of a mixing pocket) are delivered to the reservoir for each vertical travel of this elevator. The reservoir feed elevator is normally parked at its uppermost position and waits for a signal that the reservoir needs cards as indicated by the card level in the reservoir dropping below the level sensor 74A/74B. Alternatively, instead of waiting for a signal before picking up more cards, as soon as the reservoir elevator delivers its card load to the reservoir the elevator may pick up a card load from the next mixing pocket as dictated by the reservoir elevator program.

The program for the reservoir elevator is designed to obtain a good overall mix of cards so that no large "group" of cards remain together. A "group" in this context might be anything from 50 to 150 cards. It is therefore desirable to provide a program which picks up cards from a few pockets a number of times while skipping one or more other pockets. In the preferred embodiment, 6 mixing pockets are provided. A reservoir elevator program might be 42 steps long, so that each of the 6 mixing pockets are unloaded 7 times. However, to obtain a good "group" mix as described above, at any one time some pockets will have been unloaded more times than other pockets. An example of such a 42 step reservoir elevator pickup schedule or program is: 1234-1234-5-1234-6-3456-3456-1-1-3456-2-1256-1256-3--1256-4, (with "1" corresponding to pocket 34A, "2" corresponding to pocket 34B, etc.) One can see that by the time pocket No. 6 is unloaded for the first time (step 14), pockets Nos. 1, 2, 3 and 4 have already been unloaded 3 times.

A number of such 42 step pickup schedules can be provided, with random selection of the program in a manner similar to the random selection of the distribution elevator program from the set of 5 or 10 available. It may be desired for certain shuffling devices according to the invention to have distribution schedules which are different from other shuffling devices to provide even more variation in the shuffling devices made in accordance with the invention.

A program read-out plug may be provided to read out the schedules in a given shuffler for verification by the owner/operator of the establishment. Locking or security means may be provided to limit access to the plug only to authorized persons.

Figure 3:
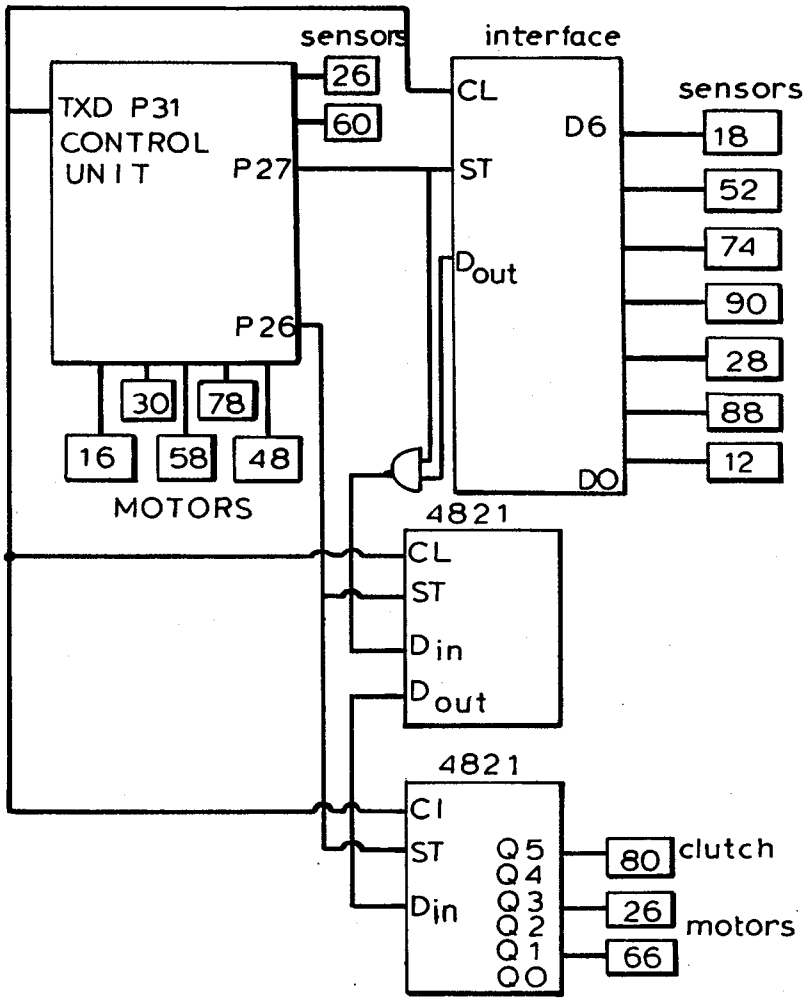
FIG. 3 is an electrical schematic showing the connection of the control unit to the various sensors and motors.

The control unit and its associated sensors and motors will now be described with reference to FIG. 3. All of the sensors and motor control leads are connected directly or indirectly to the control unit, which in the preferred embodiment is an Intel Model 8751, having on-board memory for storing the control program and distribution tables and the like. The interface block is a Motorola 74C165 IC chip. The 4821 blocks are shift registers.

Each sensor is actually a light emitting/light sensitive element pair, with the light sensor preferably being mounted in the position least sensitive to ambient and room light. When the sensor is referred to as a number with no letter suffix, e.g. 18, this refers to the pair. When the A and B suffixes are used, A refers to the light sensitive element and B refers to the light emitter. Table B at the end of this specification identifies the particular model numbers used for the sensors and motors. The control program is submitted on microfiche and contains information regarding the pin assignments of the 8751.

While a particular embodiment of a card shuffler has been shown and described, numerous variations and modifications will occur to those skilled in the art without departing from the spirit and scope of the invention, which is defined in the appended claims. For example, less than or more than six mixing pockets may be provided.

TABLE A

| Loading Order of First 50 Cards Pocket Nos. | | | | | |
|---|---|---|---|---|---|
| 1 | 2 | 3 | 4 | 5 | 6 |
| 1 | 7 | 2 | 6 | 3 | 4 |
| 8 | 9 | 12 | 10 | 5 | 20 |
| 16 | 13 | 15 | 14 | 11 | 26 |
| 23 | 17 | 18 | 21 | 19 | 28 |
| 33 | 22 | 24 | 29 | 25 | 36 |
| 43 | 31 | 30 | 35 | 27 | 39 |
| 45 | 34 | 32 | 37 | 38 | 48 |
| | 42 | 41 | 47 | 40 | 50 |
| | 44 | 46 | 49 | | |

TABLE B

| | Model |
|---|---|
| Sensors | |
| 36, 60 | Honeywell HOA 2762-1 |
| 90 | Honeywell HOA 0825-001 |
| 42 B, 52 B | GE SL5A |
| 18 B, 28 B, 74 B | Honeywell 2120A 1003A |
| 18 A, 28 A, 42 A, 52 A, 74 A, 88 A | Honeywell 2120A 1004A |
| Motors | |
| 16, 78 | 12VDC |
| 26, 66 | Crouzet 82910 |
| 30, 48, 58 | Oriental Motor PXB4 3H-02AA |

I claim:

1. A card shuffler comprising a fixed stack of mixing pockets for accumulating a plurality of cards in each pocket, each mixing pocket having an entrance end and a discharge end, a distribution elevator which moves along the entrance ends of the mixing pockets and feeds at least one card at a time to said mixing pockets in accordance with a first distribution schedule, a reservoir feed elevator which moves along the discharge ends of the mixing pockets for receiving the cards accumulated in the mixing pockets in accordance with a second distribution schedule and an output reservoir to which the cards are fed from the reservoir feed elevator.

2. A card shuffler according to claim 1 including a gate closing the discharge end of each mixing pocket and means controlled by the reservoir feed elevator for opening the gate of the mixing pocket from which the reservoir feed elevator is to receive the cards accumulated in the mixing pocket.

3. A card shuffler according to claim 1 including a loading station for receiving a stack of cards to be shuffled, and means for transferring a card stack to said distribution elevator.

4. A card shuffler according to claim 3 wherein the means for transferring a card stack comprises conveyor rollers in the bottom of said loading station and means for moving the rollers, to roll the card stack into the distribution elevator when it is in a position adjacent said loading station.

5. A card shuffler according to claim 1 wherein the distribution elevator comprises an elevator floor and side walls, an opening in the base of a side wall for passing a card therethrough and friction rollers mounted in said floor for feeding one card at a time from the bottom of the card stack through said opening.

6. A card shuffler according to claim 5 wherein the distribution elevator includes a pivotal pressure arm for exerting pressure on top of the stack of cards to aid engagement of the bottom card in the stack with said friction rollers and means for raising the pivotal pressure arm when the elevator is in loading position.

7. A card shuffler according to claim 1 wherein each mixing pocket has a set of feed rollers between the respective mixing pocket and the distribution elevator for receiving a card fed from the distribution elevator and feeding the card into the mixing pocket and a gate at the discharge end of each mixing pocket to retain the cards until they are to be received by said reservoir feed elevator.

8. A card shuffler according to claim 1 including means for detecting when the level of cards in the output reservoir drops below a predetermined level and means controlled by said detecting means for activating the reservoir feed elevator.

9. A card shuffler according to claim 1 including a dealing slot and means for feeding the lowermost card one at a time in sequence from the output reservoir to the dealing slot in response to a control signal.

10. A card shuffler according to claim 9 wherein the output reservoir has a bottom and an opening defined between said bottom and a side wall for allowing only one card at a time therethrough, and wherein the means for feeding comprises feed rollers at the bottom.

11. A card shuffler according to claim 10 wherein the means for feeding further includes a pair of exit rollers located between the output reservoir opening and the dealing slot for catching a card fed by said feed rollers and for feeding the card into the dealing slot.

12. A card shuffler according to claim 1 wherein the first distribution schedule provides for a delivery of cards wherein each mixing pocket receiving a card in the schedule is located within a predetermined number of mixing pockets away from the mixing pocket immediately previously receiving a card, wherein the predetermined number is less than the number of mixing pockets.

13. A card shuffler according to claim 1 wherein the first distribution scehdule provides for delivery of a substantially equal number of card to each mixing pocket.

14. A card shuffler according to claim 1 wherein the first distribution schedule comprises a number of programs, and wherein means are provided for randomly selecting a program for controlling the delivery of cards.

15. A card shuffler according to claim 1 wherein the second distribution schedule provides for pickup of cards from each mixing pocket a number of times equal to the number of pickups from other mixing pockets.

16. A card shuffler according to claim 1 wherein the second distribution schedule provides for pickup of cards from the mixing pockets in sequence wherein cards are not picked up from one mixing pocket until cards are picket up from at least several other mixing pockets at least two times, to thereby provide a good shuffling of cards.

17. A card shuffler as set forth in claim 1 including means for detecting when a mixing pocket is full and for moving the distribution elevator to the next position according to the distribution program.

* * * * *

UNITED STATES PATENT AND TRADEMARK OFFICE

CERTIFICATE OF CORRECTION

PATENT NO. : 4,770,421

DATED : September 13, 1988

INVENTOR(S) : Lionel Hoffman

It is certified that error appears in the above-identified patent and that said Letters Patent is hereby corrected as shown below:

Col. 5, line 28, "machines" should read --machine--. Col. 7, line 44, "-1-1-" should read -- -1- --. Col. 10, line 36, "picket" should read --picked--.

Signed and Sealed this

Thirty-first Day of January, 1989

*Attest:*

*Attesting Officer*

DONALD J. QUIGG

*Commissioner of Patents and Trademarks*